US008387549B2

(12) United States Patent
De Baan

(10) Patent No.: US 8,387,549 B2
(45) Date of Patent: Mar. 5, 2013

(54) ASSEMBLY OF TURRET AND DISCONNECTABLE BUOY

(75) Inventor: Jacob De Baan, Maassluis (NL)

(73) Assignee: Bluewater Energy Services B.V., Hoofddorp (NL)

( * ) Notice: Subject to any disclaimer, the term of this patent is extended or adjusted under 35 U.S.C. 154(b) by 97 days.

(21) Appl. No.: 12/668,928

(22) PCT Filed: Jul. 16, 2007

(86) PCT No.: PCT/EP2007/057319

§ 371 (c)(1),
(2), (4) Date: Apr. 14, 2010

(87) PCT Pub. No.: WO2009/010089

PCT Pub. Date: Jan. 22, 2009

(65) Prior Publication Data

US 2010/0190393 A1 Jul. 29, 2010

(51) Int. Cl.
*B63B 21/00* (2006.01)

(52) U.S. Cl. ..... 114/230.12; 441/3

(58) Field of Classification Search ..... 114/230.12, 114/230.13; 441/3, 4, 5

See application file for complete search history.

(56) References Cited

U.S. PATENT DOCUMENTS 4,637,335 A * 1/1987 Pollack ..... 114/230.12
5,240,446 A * 8/1993 Boatman et al. ..... 441/3
5,339,760 A * 8/1994 Korsgaard ..... 441/3
5,363,789 A * 11/1994 Laurie et al. ..... 441/4
5,372,531 A * 12/1994 Boatman et al. ..... 441/4
6,595,154 B2 * 7/2003 Boatman ..... 114/230.12

FOREIGN PATENT DOCUMENTS

WO WO 2007/045662 4/2007

OTHER PUBLICATIONS

International Search Report of the European Patent Office Patent Office in counterpart foreign application No. PCT/EP2007/057319 filed Jul. 16, 2007.

Written Opinion of the European Patent Office Patent Office in counterpart foreign application No. PCT/EP2007/057319 filed Jul. 16, 2007.

* cited by examiner

*Primary Examiner* — Lars A Olson

(74) *Attorney, Agent, or Firm* — Steven M. Koehler; Westman, Champlin & Kelly P.A.

(57) ABSTRACT

Assembly of turret and disconnectable buoy, in which the turret at its lower end and the buoy at its upper end are provided with mating coupling provisions. The coupling provisions comprise an annular projection protruding from one of the turret and buoy towards the other of the turret and buoy and a correspondingly shaped annular recess on the other of the turret and buoy for receiving the annular projection. The annular projection has a base which is wider than a top thereof, whereas the annular recess has a top which is wider than a base thereof.

18 Claims, 1 Drawing Sheet

ASSEMBLY OF TURRET AND DISCONNECTABLE BUOY

CROSS-REFERENCE TO RELATED APPLICATION

The present application is a national stage filing of International patent application Serial No. PCT/EP2007/057319, filed Jul. 16, 2007, and published as WO 2009/010089 in English.

BACKGROUND

The discussion below is merely provided for general background information and is not intended to be used as an aid in determining the scope of the claimed subject matter. Aspects of the invention relates to an assembly of turret and disconnectable buoy, in which the turret at its lower end and the buoy at its upper end are provided with mating coupling provisions.

In offshore oil production, use is made of so called FPSO's (Floating Production, Storage and Offloading). FPSO's are ships which are permanently or semi-permanently anchored offshore at an oilfield for the purpose of receiving well fluids from the oil reservoir, separating the oil from the water and gas and storing the oil on board for later transfer to another vessel. Generally, the FPSO's are anchored by means of single point mooring systems of the internal or external turret type.

In some areas of the world, weather conditions can deteriorate so badly, such as due to hurricanes, that it is required to enable the FPSO to disconnect from its anchoring system and sail temporarily to safer waters. Likewise, in iceberg infested waters it is sometimes necessary to disconnect the FPSO to avoid damage to the vessel.

In these instances use is made of an disconnectable turret mooring system, which can be of the internal or the external type (in the one case the turret is fitted within the confines of the vessel hull, in the other case the turret is fitted forward of the bow of the vessel), comprising a disconnectable buoy, wherein the turret at its lower end and the buoy at its upper end are provided with mating coupling provisions.

In the design of a disconnectable turret particular care needs to be given to the interface between the lower end of the turret and the upper end of the disconnectable buoy.

Ideally this interface is preloaded in such a way as to avoid that a gap is created between the turret and the buoy under external anchoring and wave load conditions. Since generally the turret and the buoy are cylindrical or conical structures with a large diameter, it is also important to interlock these structures in such a way that both act as a single structure when connected. Another objective is to achieve a good fit between the structures at their interface, without resorting to tight and hence expensive machining tolerances.

The assemblies according to the state of the art provide a buoy with a protruding conical upper end which has to be received in a correspondingly shaped conical lower recess of the turret. These known assemblies suffer from the significant drawback that whereas the conical interface eases fit up of the two structures, the conical recess must be fabricated extremely heavy and sturdy to resist the radial loads which follow from the two parts being connected. Very significant preload is required to assure that the buoy and turret do not separate under external loads arising from anchoring and waves. If such preload cannot be achieved sufficiently, locking means, which connect the disconnectable buoy to the turret, are subject to high cyclic load variations following from these anchoring and wave loads and hence may fail prematurely.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the background.

An assembly of a turret and a disconnectable buoy are provided, in which the turret at its lower end and the buoy at its upper end are provided with mating coupling provisions, wherein the coupling provisions comprise an annular projection protruding from one of the turret and buoy towards the other of the turret and buoy and a correspondingly shaped annular recess on the other of the turret and buoy for receiving the annular projection, wherein the annular projection has a base which is wider than a top thereof, whereas the annular recess has a top which is wider than a base thereof.

The annular projection and annular recess are machined to a tolerance such that if they are engaged one to another, under an axial compression force, one of these parts deforms more than the other in a radial direction such as to become compliant with the other part in a form-fit. By applying a nominal preload to this interface, both parts of the assembly now work as one single part, there being no tendency for the engaged parts to separate.

The tolerances of machining are selected such that the diameter growth of the weakest part, typically the lower end of the turret structure, under a compression force, is limited to such a percentage of tangential elongation that it avoids achieving the yield stress of the material (steel) being employed in the parts. Once this stress level is reached, a further increase of the compressive force merely increases local stresses in the radial section of the parts and increases the contact stresses between these parts. This is a very stiff load path, with a locking device which connects the disconnectable buoy to the turret forming part of a much lesser stiff load path. Hence these locking devices are not subject to any significant cyclic loads.

Since a very high internal contact stress is achieved over the tapering surfaces of the projection and recess, these parts can also act as a sealing device against the seawater to allow the turret to be pumped dry after a connect operation. An additional sealing member (e.g. a soft rubber or mild steel ring) may be fitted between the annular projection and annular recess.

BRIEF DESCRIPTION OF THE DRAWINGS

Aspects of the invention will be elucidated while referring to the drawing, in which.

DETAILED DESCRIPTION OF THE ILLUSTRATIVE EMBODIMENTS

Figure 1:
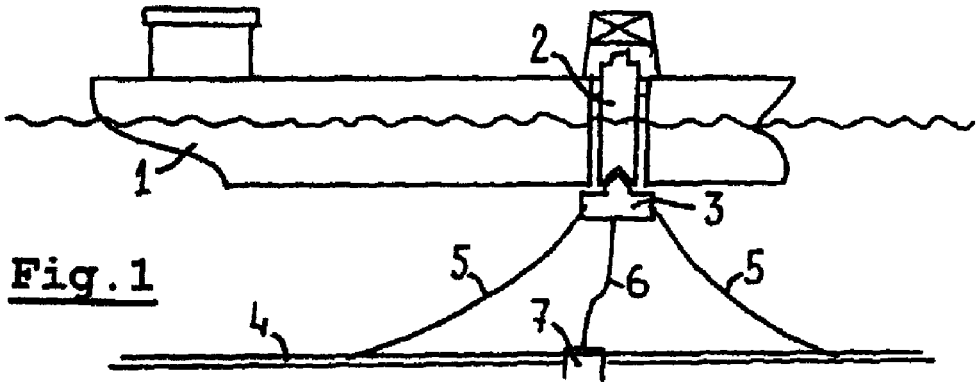
FIG. 1 shows schematically a typical FPSO with an internal turret being anchored to the seabed in a manner known per se using a disconnectable buoy.

Referring to FIG. 1, a FPSO 1 is shown which, in a manner known per se, is provided with an internal turret 2 which, at its lower end, is connected to a disconnectable buoy 3. The buoy 3 is anchored to the bottom of the sea 4 by means of anchor lines 5, whereas a production line 6 is connected between a well bore 7 and the buoy 3 (and leads further through the turret towards an appropriate on-board installation, not shown).

Figure 2:
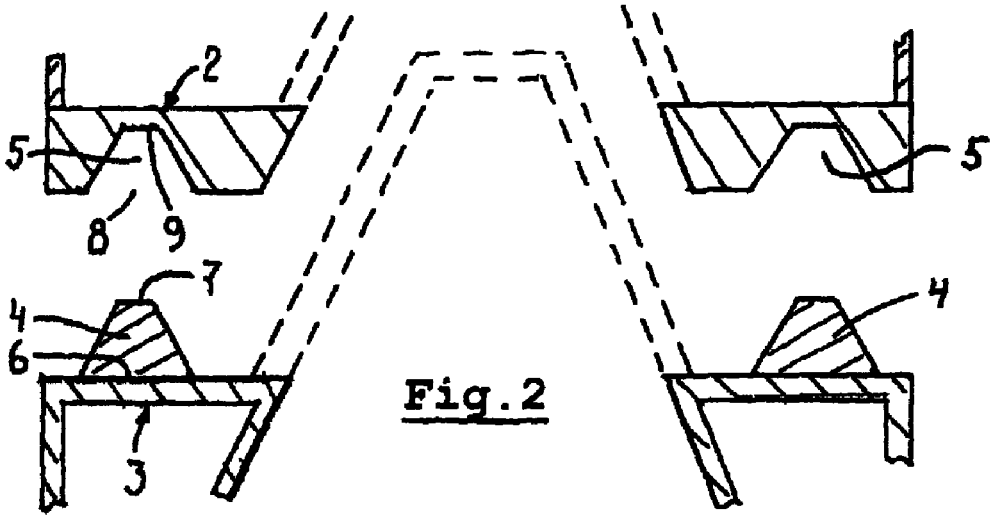
FIG. 2 shows schematically and on an enlarged scale the interface between a turret and disconnectable buoy.

Referring to FIG. 2, the interface between the lower end of the turret 2 and the upper end of the disconnectable buoy 3 is illustrated schematically in a longitudinal cross section and in a situation before being assembled. As shown, the upper end of the buoy 3 is provided with an annular projection 4 protruding from the buoy, whereas the lower end of the turret is provided with a correspondingly shaped annular recess 5 for receiving the annular projection 4. The annular projection 4 has a base 6 which is wider than a top 7 thereof, whereas the annular recess 5 has a top (mouth) 8 which is wider than a base 9 thereof. Specifically, in the illustrated embodiment, the cross-section of the annular projection 4 and annular recess 5 has a trapezoidal shape. As a result assembling these parts (i.e. entering the annular projection 4 into the annular recess 5) is very easy and leads to an optimised load path between the turret 2 and buoy 3.

It is possible too that the annular projection is part of the turret and that the annular recess is provided in the buoy. Further it is conceivable to provide more than one annular projection with corresponding annular recess; in such a case it would be possible that each of the turret and buoy comprises at least one annular projection and at least one annular recess.

It is noted that the provision of an annular projection and annular recess does not prevent that, in accordance with the state of the art, the lower end of the turret 2 and upper end of the buoy have corresponding tapering shapes (as indicated schematically in FIG. 2 by dotted lines).

Figure 3:
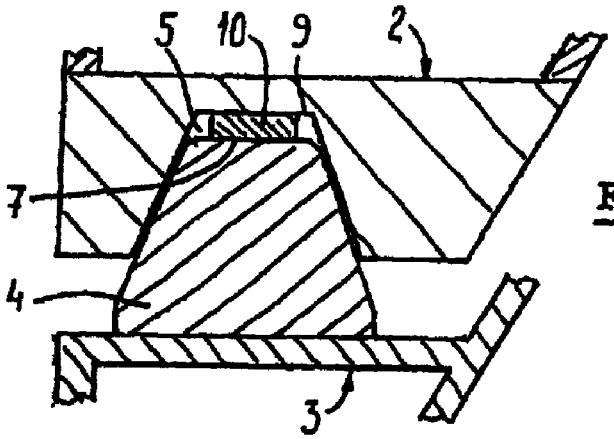
FIG. 3 shows schematically an embodiment with additional sealing member.

Finally FIG. 3 represents on a larger scale a sealing member 10 interpositioned between an annular projection 4 and an annular recess 5. Specifically the sealing member 10 is provided between the top 7 of the annular projection 4 and the base 9 of the annular recess 5. Preferably the sealing member 10 is attached to the base 9 of the annular recess. The sealing member 10 may comprise a soft rubber or mild steel ring. The invention is not limited to the embodiments described before, which may be varied widely within the scope of the invention as defined by the appending claims.

The invention claimed is:

1. An assembly of a turret and a disconnectable buoy, in which the turret at its lower end and the buoy at its upper end are provided with mating coupling provisions, wherein the coupling provisions comprise an annular projection protruding from one of the turret and buoy towards the other of the turret and buoy and a correspondingly shaped annular recess on the other of the turret and buoy for receiving the annular projection, wherein the annular projection comprises an inwardly radial facing surface and an outwardly radial facing surface and has a base which is wider than a top thereof, whereas the annular recess has a top which is wider than a base thereof, wherein the annular recess is configured to engage the inwardly radial facing surface and the outwardly radial facing surface of the annular projection as the buoy and the turret are being connected and wherein when the buoy is disconnected from the turret the annular recess is present.

2. The assembly according to claim 1, wherein the cross-section of the annular projection and annular recess has a trapezoidal shape.

3. The assembly according to claim 1, wherein the annular projection is provided on the buoy whereas the annular recess is provided in the turret.

4. The assembly according to claim 1, wherein a sealing member is provided between the annular projection and the annular recess.

5. The assembly according to claim 4, wherein the sealing member is provided between the top of the annular projection and the base of the annular recess.

6. The assembly according to claim 5, wherein the sealing member is attached to the base of the annular recess.

7. The assembly according to claim 4, wherein the sealing member is a rubber ring.

8. The assembly according to claim 4, wherein the sealing member is a steel ring.

9. A turret having a conical lower recess configured to receive a conical projection of a buoy and having at least one of an annular projection and a recess disposed about and spaced apart from the conical lower recess, wherein the annular projection has a base which is wider than a top thereof, an inwardly radial facing surface, and an outwardly radial facing surface, the inwardly radial facing surface and the outwardly radial facing surface each being spaced to engage corresponding surfaces of a recess on the buoy as the buoy and the turret are being connected, or wherein the annular recess has a top which is wider than a base thereof an inwardly radial facing surface, and an outwardly radial facing surface, the inwardly radial facing surface and the outwardly radial facing surface each being spaced to engage corresponding surfaces of a projection on the buoy as the buoy and the turret are being connected.

10. The turret according to claim 9, wherein the cross-section of the at least one of the annular projection and the annular recess has a trapezoidal shape.

11. The turret according to claim 9, wherein the turret includes the annular recess and further comprises a sealing member attached to the base of the annular recess.

12. The turret according to claim 11, wherein the sealing member is a rubber ring.

13. The turret according to claim 11, wherein the sealing member is a steel ring.

14. A buoy having a conical projection configured to be inserted in a lower conical recess of a turret and having at least one of an annular projection and a recess disposed about and spaced apart from the conical projection, wherein the annular projection has a base which is wider than a top thereof, an inwardly radial facing surface, and an outwardly radial facing surface, the inwardly radial facing surface and the outwardly radial facing surface each being spaced to engage corresponding surfaces of a recess on the turret as the buoy and the turret are being connected, or wherein the annular recess has a top which is wider than a base thereof, an inwardly radial facing surface, and an outwardly radial facing surface, the inwardly radial facing surface and the outwardly radial facing surface each being spaced to engage corresponding surfaces of a projection on the turret as the buoy and the turret are being connected.

15. The buoy according to claim 14, wherein the cross-section of the at least one of the annular projection and the annular recess has a trapezoidal shape.

16. The buoy according to claim 14 wherein the turret includes the annular recess and further comprises a sealing member attached to the base of the annular recess.

17. The buoy according to claim 16, wherein the sealing member is a rubber ring.

18. The buoy according to claim 16, wherein the sealing member is a steel ring.

* * * * *

UNITED STATES PATENT AND TRADEMARK OFFICE

CERTIFICATE OF CORRECTION

PATENT NO. : 8,387,549 B2
APPLICATION NO. : 12/668928
DATED : March 5, 2013
INVENTOR(S) : Jacob De Baan It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 184 days.

Signed and Sealed this
First Day of September, 2015

Michelle K. Lee

Michelle K. Lee
*Director of the United States Patent and Trademark Office*